US009574844B2

(12) United States Patent
Williams

(10) Patent No.: US 9,574,844 B2
(45) Date of Patent: Feb. 21, 2017

(54) PAINTBALL MARKER WITH INTERCHANGEABLE FIRING MODES

(71) Applicant: David Alan Williams, Bluffton, IN (US)

(72) Inventor: David Alan Williams, Bluffton, IN (US)

( * ) Notice: Subject to any disclaimer, the term of this patent is extended or adjusted under 35 U.S.C. 154(b) by 0 days.

(21) Appl. No.: 14/921,311

(22) Filed: Oct. 23, 2015

(65) Prior Publication Data

US 2016/0273871 A1 Sep. 22, 2016

Related U.S. Application Data

(63) Continuation of application No. 14/192,015, filed on Feb. 27, 2014, now abandoned.

(60) Provisional application No. 61/770,133, filed on Feb. 27, 2013.

(51) Int. Cl.

| | |
|---|---|
| ***F41B 11/723*** | (2013.01) |
| ***F41B 11/721*** | (2013.01) |
| ***F41A 9/68*** | (2006.01) |
| ***F41B 11/55*** | (2013.01) |
| ***F41B 11/62*** | (2013.01) |

(52) U.S. Cl.

CPC ..... *F41B 11/723* (2013.01); *F41A 9/68* (2013.01); *F41B 11/55* (2013.01); *F41B 11/62* (2013.01); *F41B 11/721* (2013.01); *Y10T 29/49716* (2015.01)

(58) Field of Classification Search

CPC ..... F41B 11/55; F41B 11/62; F41B 11/641; F41B 11/646; F41B 11/721; F41B 11/723; F41B 11/72; F41A 9/68; Y10T 29/49716

USPC ..... 124/63–67, 69–72, 74, 76; 42/73

See application file for complete search history.

(56) References Cited

U.S. PATENT DOCUMENTS

| | | | | |
|---|---|---|---|---|
| 5,503,137 A * | 4/1996 | Fusco | F41B 11/62 | 124/56 |
| 6,637,420 B2 * | 10/2003 | Moritz | F41B 11/57 | 124/73 |
| 2008/0028662 A1 * | 2/2008 | Abraham | F41C 23/14 | 42/73 |
| 2013/0047481 A1 * | 2/2013 | Macy | F41A 9/68 | 42/49.01 |
| 2014/0060512 A1 * | 3/2014 | Macy | F41B 11/62 | 124/73 |
| 2014/0096755 A1 * | 4/2014 | Larmer | F41B 11/55 | 124/52 |

* cited by examiner

*Primary Examiner* — John D Cooper
(74) *Attorney, Agent, or Firm* — Faegre Baker Daniels LLP

(57) ABSTRACT

The present disclosure discloses a paintball marker capable of interchanging between a bolt action firing valve and a spool action firing valve. The present disclosure further provides a method of interchanging between the bolt action firing valve and the spool firing valve.

17 Claims, 15 Drawing Sheets

PAINTBALL MARKER WITH INTERCHANGEABLE FIRING MODES

CROSS-REFERENCE TO RELATED APPLICATION

This application is a continuation application of U.S. patent application Ser. No. 14/192,015, filed Feb. 27, 2014 entitled PAINTBALL MARKER WITH INTERCHANGEABLE FIRING MODES, to David A. Williams which claims the benefit of U.S. Provisional Patent Application Ser. No. 61/770,133, filed Feb. 27, 2013, entitled PAINTBALL MARKER WITH INTERCHANGEABLE FIRING MODES, to David A. Williams, the entire disclosures of which are expressly incorporated by reference herein.

BACKGROUND OF THE DISCLOSURE

Field of the Disclosure

The present disclosure relates to paintball markers. More specifically, the field of the present disclosure is that of a paintball marker capable of interchanging between various firing modes and a method of interchanging between the various firing modes.

Description of the Related Art

Paintball markers are used in the recreational activity paintball, to shoot a projectile (e.g., a paintball) containing paint or a marking substance at an opponent. Paintball markers typically utilize compressed air or gas, such as carbon dioxide (CO2), to project the paintball from the paintball marker. In general, paintballs comprise thin shell encapsulates which are designed to break upon contacting an opponent thereby marking the opponent with the encapsulated paint or marking substance.

Most paintball markers share some common components. For example, paintball markers typically include a barrel from which the paintball is discharged, a trigger which induces firing of the paintball, a reservoir capable of holding a plurality of paintballs, and an intake for compressed air or gas.

Different paintball markers may also have different modes for firing paintballs. Manual paintball markers, for example, discharge only a single paintball per trigger pull while automatic firing paintball markers can discharge multiple paintballs per trigger pull. Although the discharge rate of paintballs with manual paintball markers is decreased, in some instances such as tournament play manual paintball markers are preferred or even required.

SUMMARY OF THE DISCLOSURE

The present disclosure relates to a paintball marker. According to some embodiments, the paintball marker includes a frame portion, a trigger mechanism, a barrel for propelling a paintball therefrom, a bolt action firing valve, and a receiver portion at least partially received into the frame portion and coupled to the trigger mechanism. The barrel is coupled to either the receiver portion or the frame portion and the receiver portion defines a firing chamber sized to reversibly receive the bolt action firing valve and secure the bolt action firing valve in a first orientation in the firing chamber. The receiver portion is also adapted to receive a paintball from a paintball reservoir and compressed gas from an external source to propel the paintball.

According to another embodiment of the present disclosure, a method of interchanging a bolt action firing valve with a spool firing valve within a paintball marker is disclosed. The method, according to such embodiment includes the steps of disposing a receiver at least partially within a frame, placing a bolt action firing valve disposed within the receiver in a post-fired state, and removing the bolt action firing valve from a firing chamber defined by the receiver. The step of removing the bolt action firing valve includes removal of at least one valve securing pin from a valve securing pin opening defined by the receiver and retracting the bolt action firing valve through an opening defined by the receiver. The method also includes the step if inserting a spool firing valve into the firing chamber of the receiver by inserting the spool firing valve through the opening, this step including placing the spool firing valve in a first configuration within the firing chamber of the receiver. Further, the method includes the step of inserting the at least one valve securing pin through the valve securing pin opening defined by the receiver, this step further including disposing the at least one valve securing pin within an aperture defined by the spool firing valve.

Additionally, the instant disclosure provides a paintball marker magazine adapted to couple to a receiver of a paintball marker. The magazine includes a frame which defines a first and a second opening sized to allow a paintball to pass therethrough. The magazine further includes a receiver coupling component which is configured to couple the magazine to a receiver of a paintball marker in a first orientation. The magazine also includes a first paintball column having a plurality of paintballs aligned vertically on top of each other, and in which the first paintball column is vertically aligned underneath the first opening. Even further, the magazine also includes a second paintball column having a second plurality of paintballs aligned vertically on top of each other, in which the second paintball column vertically aligned underneath the second opening. According to the instant disclosure the magazine also includes a coil spring which is configured to supply a substantially consistent force onto each of the first and second paintball columns in a direction toward the first and second opening respectively.

In one exemplary embodiment of the instant disclosure, a paintball marker is provided. The paintball marker comprises a frame portion, a trigger mechanism, a barrel for propelling a paintball therefrom, and a receiver portion adapted to receive a paintball from a paintball reservoir. The receiver portion includes a bolt having an open position allowing the receiver portion to receive the paintball from the paintball reservoir and a closed position blocking the receiver portion from receiving the paintball from the paintball reservoir. The receiver portion is adapted to receive a compressed gas from an external source to propel the paintball. The receiver is adapted to: move the bolt into the closed position by applying pressure from the compressed gas to an internal chamber in fluid contact with the bolt, the internal chamber being selectively opened by movement of a poppet between a first and second position, moving the poppet from the first position to the second to release pressure from the internal chamber upon activation of the trigger mechanism, propelling the paintball from the barrel of the paintball marker with the compressed gas, moving the bolt from the closed position to the open position with a second spring, loading a paintball into the receiver from the paintball reservoir, returning the poppet to the first position to close the internal chamber, moving the bolt into the closed position by applying pressure from the compressed gas to the internal chamber in fluid contact with the bolt.

BRIEF DESCRIPTION OF THE DRAWINGS

The features of this disclosure, and the manner of attaining them, will become more apparent and the disclosure itself will be better understood by reference to the following description of embodiments of the disclosure taken in conjunction with the accompanying drawing.

Figure 1:
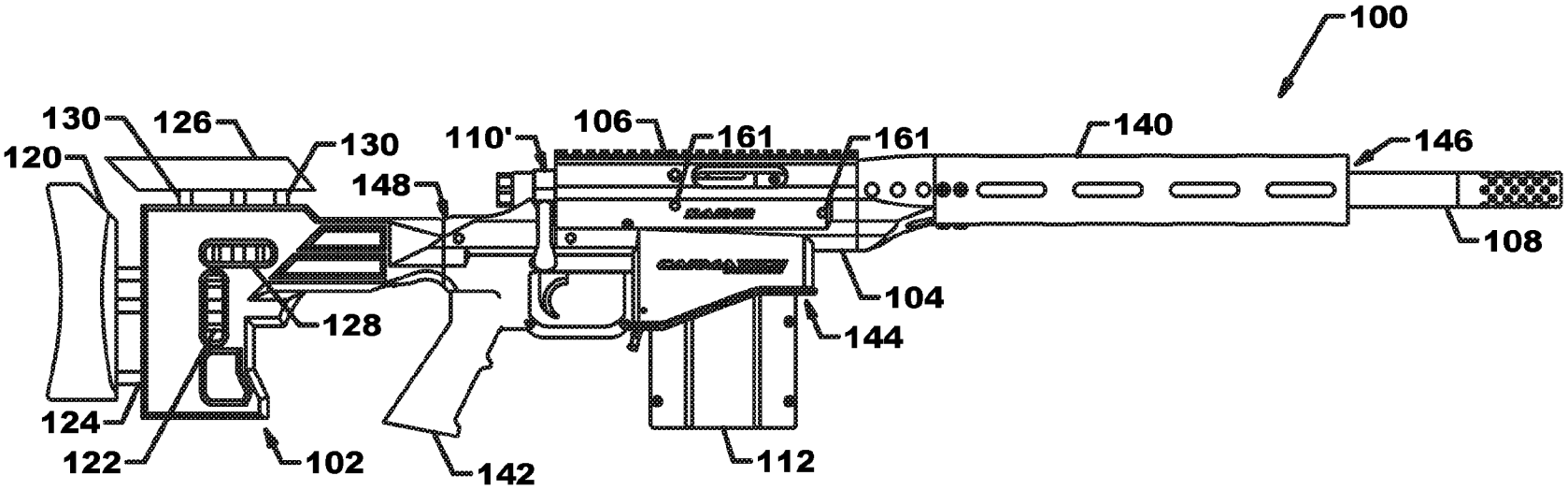
FIG. 1 is a side view of an embodiment of a paintball marker including a bolt action firing valve.

Corresponding reference characters indicate corresponding parts throughout the several views. Although the drawings represent embodiments of the present disclosure, the drawings are not necessarily to scale and certain features may be exaggerated in order to better illustrate and explain the present disclosure. The exemplifications set out herein illustrate an exemplary embodiment of the disclosure, in one form, and such exemplifications are not to be construed as limiting the scope of the disclosure in any manner.

DETAILED DESCRIPTION OF THE EMBODIMENTS OF THE DISCLOSURE

The embodiments disclosed herein are not intended to be exhaustive or limit the disclosure to the precise form disclosed in the following detailed description. Rather, the embodiments are chosen and described so that others skilled in the art may utilize their teachings.

Figure 2:
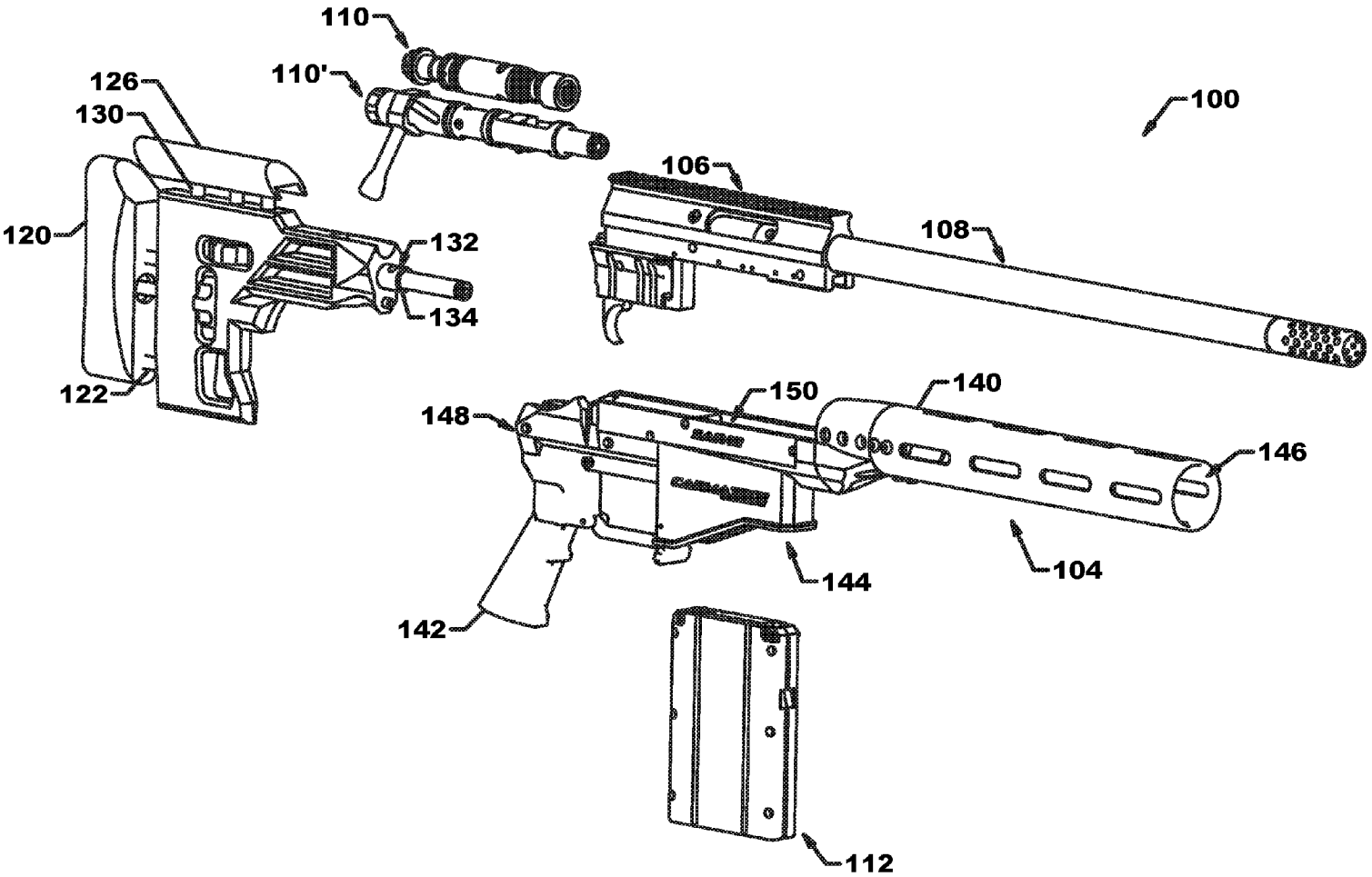
FIG. 2 is an exploded view of an embodiment of a paintball marker illustrating both a bolt action firing valve and a spool firing valve.

Paintball marker 100 is depicted in FIG. 1 for shooting a paintball. As depicted in FIG. 2, paintball marker 100 includes stock portion 102, frame or chassis 104, receiver 106, barrel 108, firing valve 110, 110', and magazine 112. As disclosed and described herein, firing valve 110 of paintball marker 100 may comprise bolt action firing valve 20 (FIG. 5*a*), spool firing valve 260 (FIG. 6*a*), and pump action firing valve (not illustrated). Paintball marker 100 allows a user to switch between the various firing valves 100 for any reason.

Figure 3:
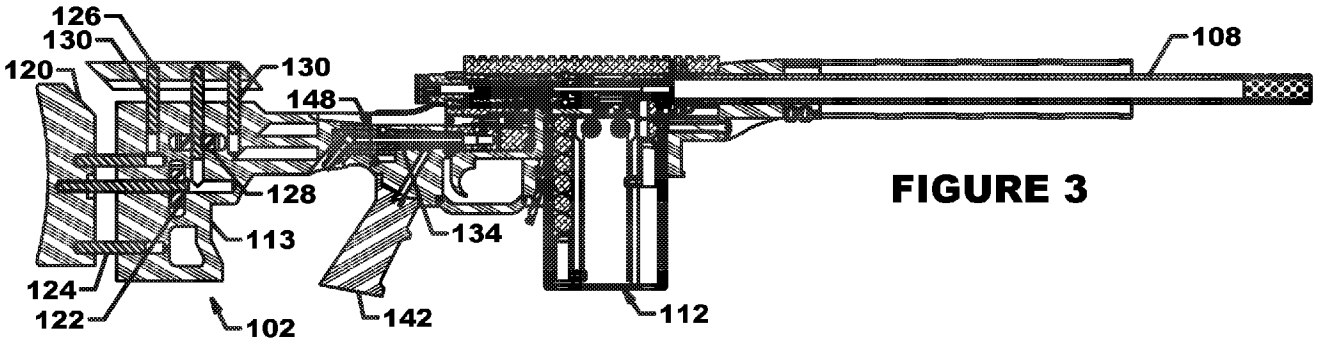
FIG. 3 is a cross-sectional view of an embodiment of a paintball marker including a bolt action firing valve.

With reference to FIG. 3, stock portion 102 includes stock frame 113, shoulder abutment 120, shoulder abutment adjuster 122, and shoulder abutment extension rods 124. Activation of adjuster 122 in a first direction (e.g., counter-clockwise) causes extension rods 124 to extend out of stock frame 113 while activation of adjuster 122 in a second direction (e.g., clockwise) causes extension rods 124 to retract into stock frame 113. Shoulder abutment 120 is coupled to extension rods 124 such that when extension rods 124 extend out of or retract into stock frame 113, shoulder abutment 120 positioning relative to stock frame 113 is adjusted. Although exemplified in FIG. 3 as a rotatably knob or wheel affixed to stock frame 113, it should be understood that adjuster 122 may take various forms capable of causing extension rods 124 to extend from stock frame 113. Additionally, while exemplified herein as comprising three extension rods 124, stock portion 102 may include one, two, or more than three shoulder abutment extension rods 124.

Remaining with FIG. 3, stock portion 102 further includes facial abutment

126, facial abutment adjuster 128, and facial abutment extension rods 130. Activation of adjuster 128 in a first direction (e.g., counter-clockwise) causes extension rods 130 to extend out of stock frame 113 while activation of adjuster 128 in a second direction (e.g., clockwise) causes extension rods 130 to retract into stock frame 113. Facial abutment 126 is coupled to extension rods 130 such that when extension rods 130 extend out of or retract into stock frame 113, facial abutment 126 positioning relative to stock frame 113 is adjusted. Although exemplified in FIG. 3 as a rotatable knob or wheel affixed to stock frame 113, it should be understood that adjuster 128 may take various forms capable of causing extension rods 130 to extend from stock frame 113. Additionally, while exemplified herein as comprising three extension rods 130, stock portion 102 may include one, two, or more than three facial abutment extension rods 130.

Returning to FIG. 2, stock frame 113 includes attachment element 132 having insert adapter 134 which is adapted to cooperate with stock receiving portion 148 of frame 104 in order to secure stock portion 102 with frame 104. Although illustrated herein as couplable separate components, it is within the scope of the present disclosure that stock portion 102 and frame 104 comprise a single component of paintball marker 100. Continuing with FIG. 2, frame 104 is depicted including frame body 140 and handle 142. Frame body 140 defines magazine receiving portion 144, barrel receiving portion 146, stock receiving portion 148, and receiver receiving portion 150. Insert adapter 134 (of stock portion 102) is received within stock receiving portion 148 of frame 104 (FIG. 3), and secured thereto with a connection pin which secures insert adapter 134 to frame 104. As illustrated in FIG. 1, barrel receiving portion 146 is adapted to receive barrel 108, magazine receiving portion 144 is adapted for receiving magazine 112, and receiver receiving portion 150 is adapted for receiving receiver 106, where receiver 106 is secured in frame 104 by receiver securing pins 161.

Figure 4B:
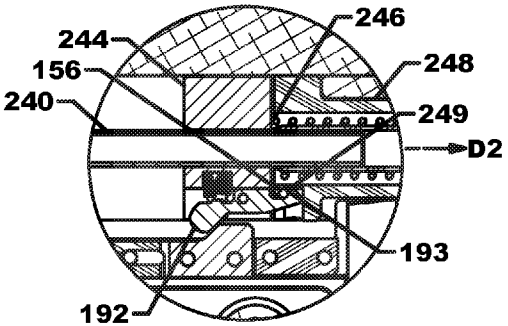
FIG. 4*b* is a magnified view of the encircled region of FIG. 4*a*.
Figure 4A:
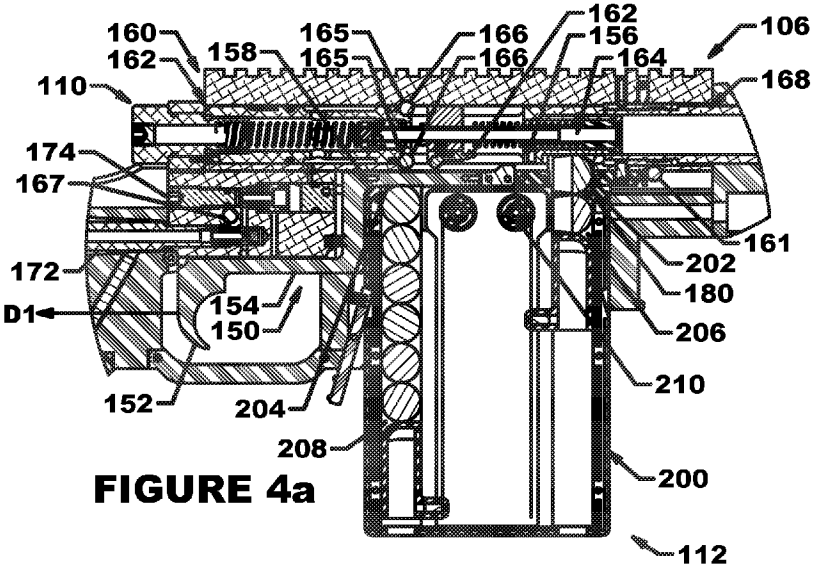
FIG. 4*a* is a cross-sectional view of a receiver and magazine of an embodiment of a paintball marker including the bolt action firing valve.

Referring next to FIG. 4*a*, receiver 106 is illustrated including trigger assembly 150, firing valve guide assembly 160, intake assembly 170, and magazine connection assembly 180. Trigger assembly 150, as shown in FIG. 4*a*, includes trigger 152, lever arm 154, and sear latch 156. While trigger assembly 150 is illustrated in FIGS. 2 and 4*a* as a rigidly affixed component of receiver 106, it should be understood that trigger assembly 150 may also be detachable from receiver 106.

In the embodiment of trigger assembly 150 illustrated in FIG. 4*a*, activation of trigger 152 by applying a force to trigger 152 in direction D1 causes trigger 152 to slide in direction DI. Sliding of trigger 152 in direction D1 causes lever arm 154 to move in the direction D1 such that sear latch 156 is displaced to direction DI. Displacement of sear latch 156 towards direction D1 creates an alteration in the orientation of hammer sear 162 (FIG. 4*b*).

Another exemplary embodiment of trigger assembly 150 (not illustrated) may include a translation pin positioned at location 158 of FIG. 4*a*. According to this embodiment of trigger assembly 150, when a force is applied to trigger 152 in direction D1, trigger 152 rotates clockwise about the translation pin at position 158. Rotation of trigger 152 about translation pin 158 causes displacement of lever arm 154 such that sear latch 156 is displaced in direction DI. Displacement of sear latch 156 towards direction D1 creates an alteration in the orientation of hammer sear 162 (FIG. 4*b*).

Figure 5F:
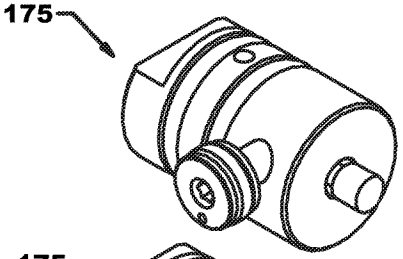
FIG. 5*f* is a magnified perspective view of a selector component having the selector switch set on bolt action firing and a magnified perspective cross-section view of the selector component.
Figure 5F:
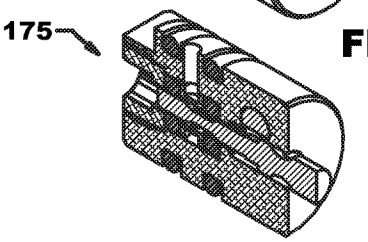
Figure 6J:
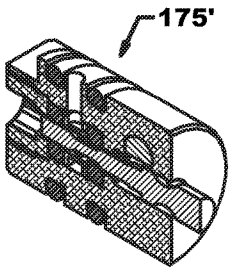
FIG. 6*j* is a magnified cross-sectional view of a selector component of the spool action firing valve in a post-fired state.
Figure 6H:
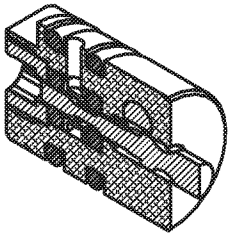
FIG. 6*h* is a magnified cross-sectional view of a selector component of the spool action firing valve in a ready-to-fire state.
Figure 6F:
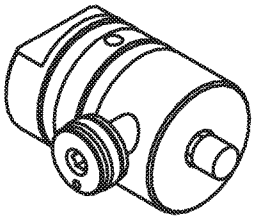
FIG. 6*f* is a magnified perspective view of a selector component having the selector switch set on spool firing valve.

Further, according to exemplary embodiments of trigger assembly 150, including embodiments advantageous for use with semi-automatic and automatic embodiments of paintball marker 100, activation of trigger 152 (e.g., by sliding in direction D1 or translating about translation pin 158) may bring about a positional change in firing valve 110 within receiver 106 or regulator 174 (such as regulator valve 177) within intake assembly 170 (both discussed below). As is seen in FIG. 6*h*, a firing pin within selector component 175' is translated from a ready-to-fire state (FIG. 6*h*), in which compressed air or gas is travels through Port 1, and a post-fired state (FIG. 6*j*) in which the seal between the firing pin and 0 Ring 1 is relieved allowing compressed gas to pass by 0 Ring 1 and through Port 2. A exemplary selector component 175 which may be utilized with a bolt action firing valve is presented in FIG. 5*f* depicting the firing pin being stationary and creating a seal with 0 Ring 2, whereby the compressed air or gas is free to pass into bolt action firing valve through Ports 1 and 2.

Although described herein by two exemplary embodiments, it is within the scope of the present disclosure that lever arm 154 movement may occur in any of a variety of manners, including rotation, sliding, pivoting of lever arm 154, and combinations thereof. Further, while trigger assembly 150 is illustrated herein as comprising manual function, it should also be understood that trigger assembly 150 comprising electronic function is also within the scope of the present disclosure.

Remaining with FIG. 4*a*, an exemplary embodiment of intake assembly 170 is depicted including intake valve 172 and regulator 174. During use, intake valve 172 couples to an external compressed air or gas tank, such as a carbon dioxide (002) tank. Regulator 174 operates in concert with trigger assembly 150 and firing valve 110 for controlling the insertion of compressed air or gas into firing chamber 164.

Figure 4D:
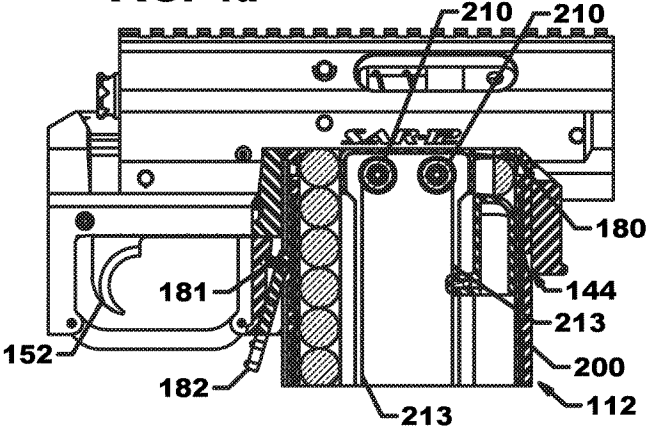
FIG. 4*d* is a magnified view of the magazine connection assembly of FIG. 4*a*.
Figure 4F:
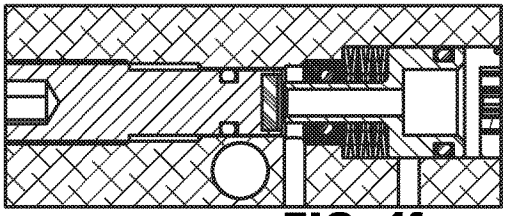
FIG. 4*f* is a magnified view of the regulator of FIG. 4*a*.
Figure 4G:
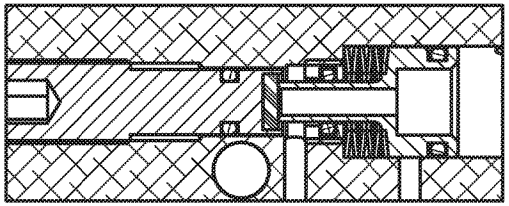
FIG. 4*g* is another magnified view of the regulator of FIG. 4*a*.
Figure 4C:
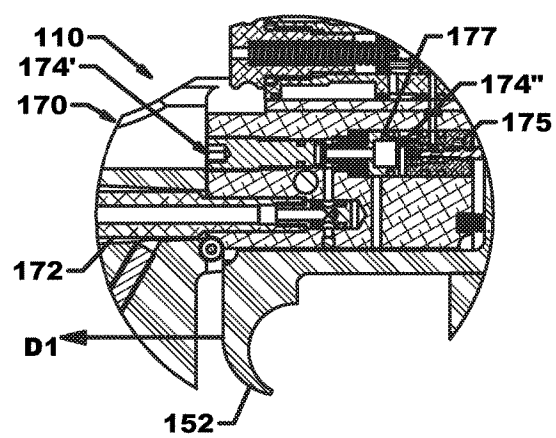
FIG. 4*c* is a magnified view of the intake assembly of FIG. 4*a*.

With reference to FIG. 4*c*, an exemplary intake assembly 170 is shown. As depicted, compressed air or gas enters paintball marker 100 at intake valve 172 where it travels to regulator 174, which may comprise a first portion 174' and a second portion 174". According to the exemplary embodiment of regulator, the compressed gas may first enter first portion 174' of regulator 174, which may comprise a high pressure chamber when in the ready-to-fire state. As illustrated in FIG. 4*c*, when in a post-firing or resting state, the compressed gas is prevented from passing from first portion 174' into second portion 174" (shown in the exemplary embodiment as being blocked by an end of regulator valve 177 having an 0-ring).

Remaining with FIG. 4*c*, when trigger 152 is activated (e.g., slid in direction D1 or translated about translation pin 158, for example), compressed gas is allowed to enter second portion 174" of regulator 174. For example, activation of trigger 152 may cause regulator value 177 (under spring action) to remove the blockage between first portion 174' and second portion 174". Upon entering second portion 174" of regulator 174, the compressed gas travels to selector component 175 (FIG. 5*f*) where gas passes through Ports 1 and 2 into firing valve 110, placing paintball in a ready-to-fire state or a firing state. (Passage of gas through selector component 175' in a spool action filing valve is shown in FIGS. 6*h* and 6*j*).

Continuing with FIG. 4*a*, magazine connection assembly 180 couples magazine 112 to receiver 106. As shown in FIG. 1, magazine 112 is received in magazine receiving portion 144 of frame 104 where magazine 112 reversibly couples to receiver 106 (shown in FIG. 4*a*).

Figure 4E:
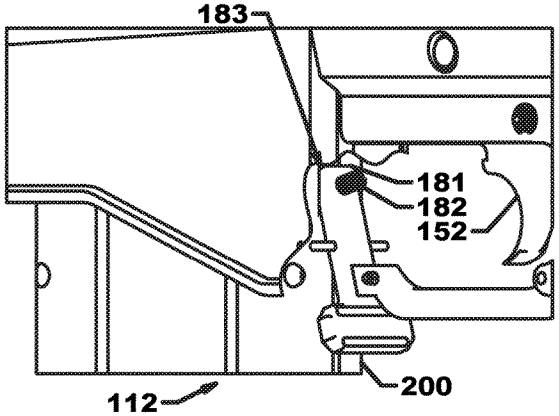
FIG. 4*e* is another magnified view of the magazine connection assembly of FIG. 4*a*.

With reference to FIG. 4*a*, an exemplary embodiment of magazine connection assembly 180 is illustrated. As shown in FIGS. 4*d* and 4*e*, magazine connection assembly 180 may include retention bracket 181 and spring-action release 182. As illustrated in FIG. 4*d*, when magazine 112 is received in receiving portion 144, at least a portion of retention bracket 181 reversibly couples (e.g., engages or partially enters) retention bracket engaging area 183 of outer casing 200 of magazine 112. Release or removal of magazine 112 from receiving portion 144 is accomplished by activating (e.g., pressing towards magazine 112) spring-action release 182, whereby the portion of retention bracket 181 coupled to (or within) retention bracket engaging area 183 is removed from retention bracket engaging area 183, allowing release of magazine 112 from receiving portion 144.

As shown in FIG. 4*a*, magazine 112 includes outer casing 200 which defines first opening 202 and second opening 204. Magazine 112 further includes first stack region 206, corresponding to a portion of magazine 112 in vertical alignment with first opening 202, and second stack region 208, corresponding to a portion of magazine 112 in vertical alignment with second opening 204. Magazine 112 allows a user to discharge all paintballs contained within first stack region 206, release (as described above) and rotate magazine 112, then reconnect magazine 112 to receiver 106 such that the paintballs within second stack region 208 may be discharged. Thus, according to some embodiments of paintball marker 100, magazine 112 is capable of being received (and reversibly coupled to receiving portion 144) in multiple orientations.

It is within the scope of the present disclosure that first and second stack regions 206, 208 may comprise any number of paintballs disposed on top of each other. For example, one exemplary embodiment of magazine 112 includes twelve paintballs aligned (or stacked) directly on top of each other in each of first and second stack regions 206, 208. Another exemplary embodiment includes twenty paintballs aligned (or stacked) directly on top of each other in each of first and second stack regions 206, 208.

Figure 7:
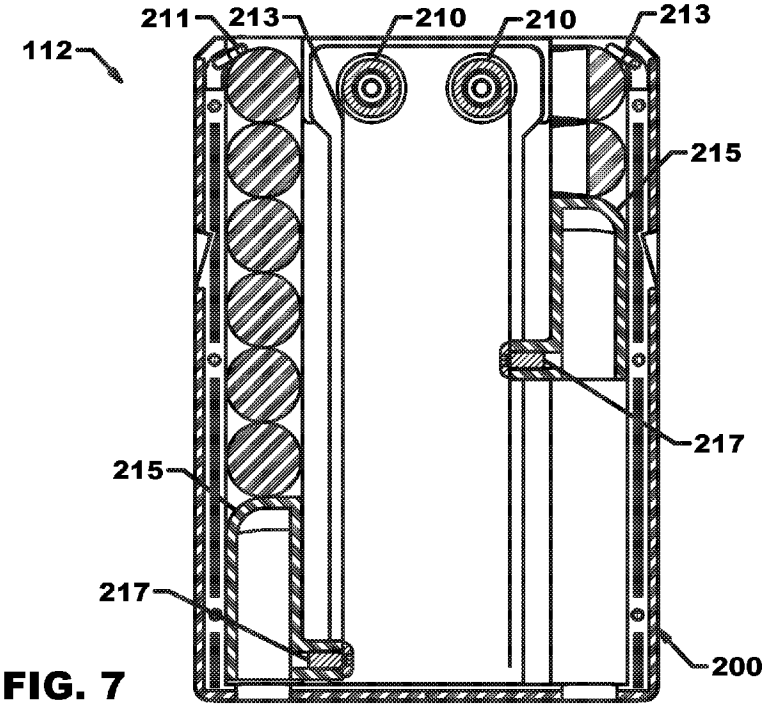
FIG. 7 is a side view of an embodiment of a magazine according to the instant disclosure.

According to some embodiments of paintball marker 100, magazine 112 utilizes coil spring 210 positioned adjacent both stack regions 206, 208. An exemplary embodiment of magazine 112 utilizing spring coil 210 is depicted in FIG. 7. As depicted, magazine 112 includes ball retainer 211, which according to the illustrated embodiment, remains in the up or retention position (depicted) under a force applied by a spring (not shown). When magazine 112 is received within receiving portion 144, ball retainer 211 is forced downward (for example, ball retainer 211 may slide down along the side of magazine 112.

According to the exemplary embodiment of magazine 112 illustrated in FIG. 7, coil spring 210 applies a consistent vertical force to the paintballs towards openings 202 and 204. For example, coil spring 210 may comprise a stainless steel strip 213 (shown in FIG. 7 as being fastened to paintball lift plate 215 by way of fastener 217) which exerts a constant force resisting uncoiling when the strip 213 is extended. This resisting force allows coil spring 210 to apply a consistent vertical force at a constant rate at all extension lengths of strip 213. By way of example, coil spring 210 may apply a constant vertical force of approximately 0.75 pounds throughout the extension of strip 213 (thus the same vertical force is applied throughout stack regions 206, 208 regardless of the number of paintballs remaining in each stack region 206, 208). By applying a constant (and same) vertical force on the paintballs within stack regions 206, 208 throughout the discharge of all paintballs, coil springs 112 allows for delicate paintballs to be loaded in larger stacks while not causing dimpling of the balls from higher forces. Further, coil springs 112 maintains a high force to continue to be applied on each paintball within stack regions 206, 208 in order to load each round into the firing chamber 164.

It should be noted that although magazine 112 is depicted herein as including coil spring 210 magazine 112 may utilize a pressure spring (not shown). Further, although magazine 112 is depicted herein as containing round paintballs, magazine 112 may contain ballistic paintballs having a shape more closely resembling a bullet. For example, First Strike Ballistic Round paintballs by Perfect Circle Paintballs Inc., and HydroTec® H2O based paintballs by HyrdoTec Inc., and the like, provide exemplary paintballs which may be utilized with paintball marker 100.

Remaining with FIG. 4*a* and returning to receiver 106, firing valve guide 160 of receiver 106 is depicted as defining valve receiving opening 162, firing chamber 164, valve securing pin openings 166, receiver securing pin openings 167, and barrel receiving opening 168. Additionally, although not depicted herein, valve guide 160 may allow for attachment of a sight or scope thereon. Exemplary embodiments of firing valve guide 160 may also define breach load opening 163 (see FIG. 1). Breach load opening 163 provides the user with the ability to load paintball marker 100 by hand, or to optionally attach a feed neck (not shown) attaching to a hopper (also not shown) filled with paintballs. As such, it should be understood that paintball marker 100 allows a user to load and operate paintball marker 100 by way of manual loading paintball rounds into breach opening 163, using a hopper (such as a standard hopper) connected to breach load opening 163 by way of a feed neck, or with magazine 112.

Although not specifically depicted herein, barrel receiving opening 168 is adapted for receiving and securing one end of barrel 108 to receiver 106. In one exemplary embodiment of paintball marker 100, barrel receiving opening 168 comprises a threaded receptacle and barrel 108 comprises a threaded end, such that the threaded end of barrel 108 screws into the thread receptacle of barrel receiving opening 168.

Valve receiving opening 162, defined by firing valve guide assembly 160, is adapted for allowing firing valve 110 to be inserted into receiver 106. With reference to FIG. 4*a*, firing valve 110 is secured in receiver 106 by way of valve securing pins 165 which are inserted through valve securing pin openings 166 of receiver 106.

Figure 5A:
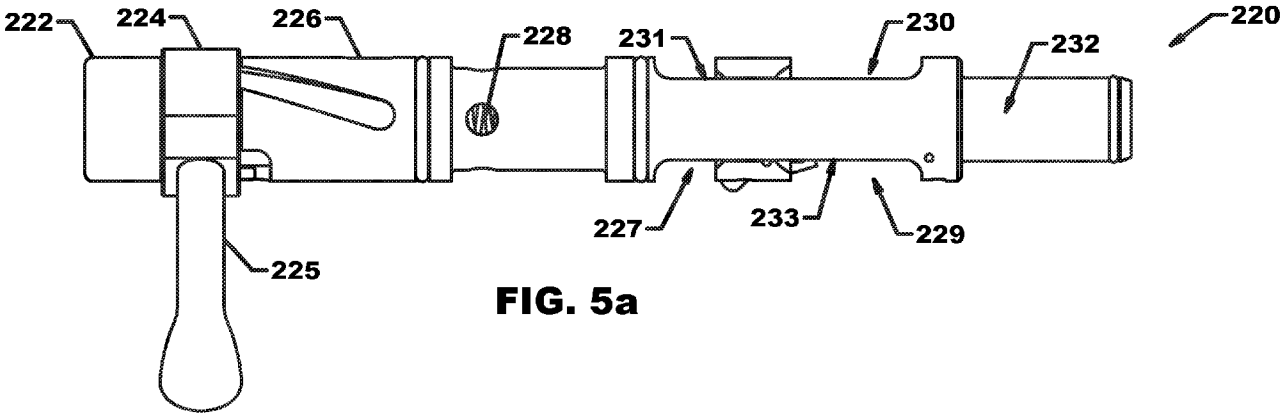
FIG. 5*a* is a side view of the bolt action firing valve.
Figure 5B:
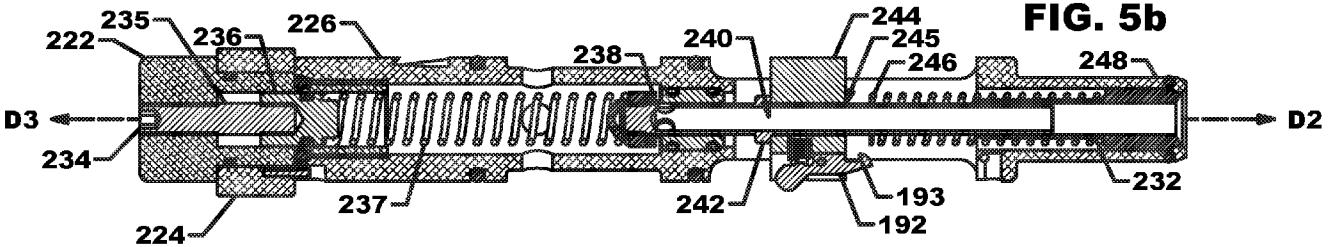
FIG. 5*b* is a cross-sectional view of the bolt action firing valve.
Figure 5G:
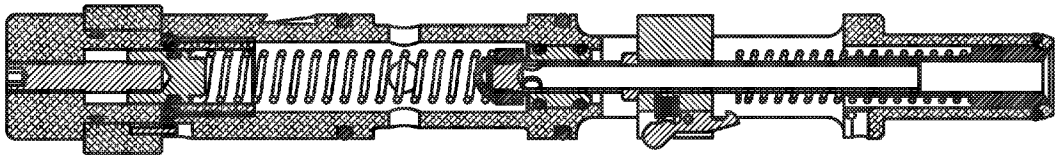
FIG. 5*g* is a cross-sectional view of a bolt action firing valve.

According to an embodiment of the present disclosure depicted in FIGS. 5*a* and 5*b*, firing valve 110 includes bolt action firing valve 220. Referring specifically to FIG. 5*a*, bolt action firing valve 220 includes end cap 222, cycle hub 224 and bolt handle 225, bolt action chassis 226, valve spring chassis 228, power tube chassis 230, and power tube guide 232. Power tube chassis 230, includes first side 227 and second side 229 and defines top opening 231 and bottom opening 233 allowing for hammer 240 to be partially disposed within, and slide within, power tube chassis 230.

With reference to FIG. 5*b*, end cap 222 is depicted as coupled to cycle hub 224 by way of hex bolt 234. Hex bolt 234, as illustrated in FIG. 5*b*, couples to valve spring adjustment driver 235 which is partially disposed within cycle hub 224. Valve spring adjustment driver 235 extends into bolt action chassis 226 and is further coupled to valve spring adjuster 236. Valve spring adjuster 236 is also disposed within bolt action chassis 226 and acts on valve spring 237 to adjust tension of valve spring 237. Valve spring 237 comprises a compression spring, which contacts valve spring adjuster 236 at a first end, also contacts power tube valve seat 238 at a second end of valve spring 237. In operation, valve spring 237 functions to return power tube valve seat 238 into a sealed (or ready-fire-state) upon a firing event. Additionally, as is described below, during the initiation of a firing event, valve spring 237 functions to absorb the inertia of hammer 244.

As shown in FIG. 5*b*, power tube 240 also includes hammer seat 242, which is shown in contact with hammer 244. As illustrated in FIG. 5*b*, hammer 244 defines opening 245 which is sized to allow power tube 240 to pass through. Opening 245 also allows hammer 244 to slide along power tube 240 in directions D2 and D3. Power tube 240 also passes through hammer spring 246 which contacts hammer 244 at a first end of hammer spring 246 and a wall of ball pusher 248 at a second end of hammer spring 246. Ball pusher 248 is sized to allow power tube 240 pass through and allow ball pusher 248 to slide along power tube 240.

Figure 5C:
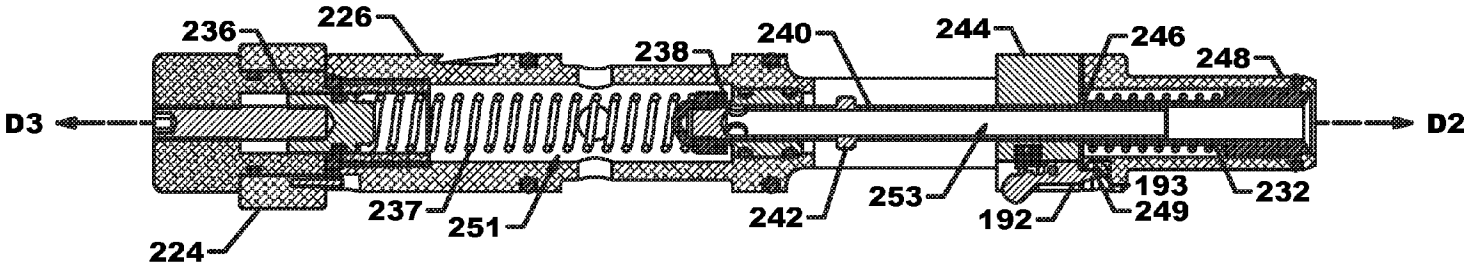
FIG. 5*c* is a view of the bolt action firing valve in a ready-to-fire state.
Figure 5D:
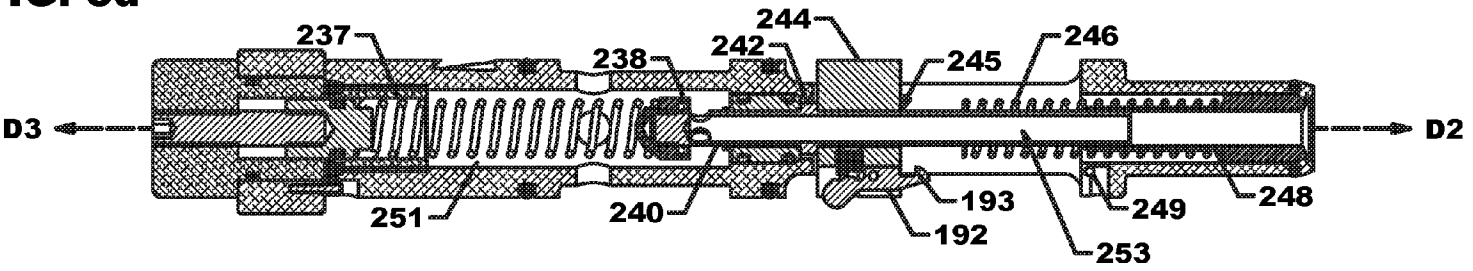
FIG. 5*d* is a view similar to FIG. 5*c* showing the bolt action firing valve in a post-fired state.

Referring next to FIG. 5*c*, an embodiment of paintball marker 100 comprising bolt action firing valve 220 in a ready-to-fire state is depicted. In order to place bolt action firing valve 220 in a ready-to-fire state, a user is required to translate cycle hub 224, in general, by turning bolt handle 225 to a first position. The user then slides bolt handle 225 in a first direction, then slides bolt handle 225 in a second direction before translating cycling hub 224, thereby placing bolt handle 225 in a second position. By way of example and with reference to FIG. 5*a*, when bolt action firing valve 220 is in a post-fire state (see FIG. 5*d*), in order to place bolt action firing valve 220 in a ready-to-fire state (see FIG. 5*c*), the user may first turn bolt handle 225 approximately 45 degrees in a counter-clockwise direction. The user may then retract bolt action firing valve 220 in direction D3 by pulling on bolt handle 225. While in a retracted position, a paintball is loaded from magazine 112 (or, for example, a hopper) into firing valve guide assembly 160 of receiver 106. The user then slides bolt action firing valve 220 in direction D2 by pushing on bolt handle 225 at which point the user may then turn bolt handle 225 approximately 45 degrees in a clockwise direction thereby placing bolt action firing valve 220 in a ready-to-fire state.

As illustrated in FIG. 5*c*, when bolt action firing valve 220 is in a ready-to fire state, hammer 244 and ball pusher 248 are in close proximity such that hammer spring 246 is highly compressed. Also illustrated in the ready-to-fire state, retaining edge 193 of hammer sear 192 is positioned such that it secures hammer 244 and ball pusher 248 in the ready-to-fire position. As shown, retaining edge 193 contacts latch rim 249 of ball pusher 248 and prevents ball pusher 248 from sliding along power tube 240 in direction D2. In the illustrated embodiment of FIG. 5*c*, hammer sear 192 is affixed to hammer 244 thereby maintaining hammer 244 and ball pusher 248 in close proximity while in a ready-to-fire state such that hammer spring 246 remains highly compressed.

Remaining with FIG. 5*c*, when in the ready-to-fire state, hammer 244 may be positioned along power tube 240 (in the D2 direction) such that hammer 244 is not in contact with hammer seat 242. Additionally, valve spring 237 may be in an extended (or reduced tension) state.

Figure 5E:
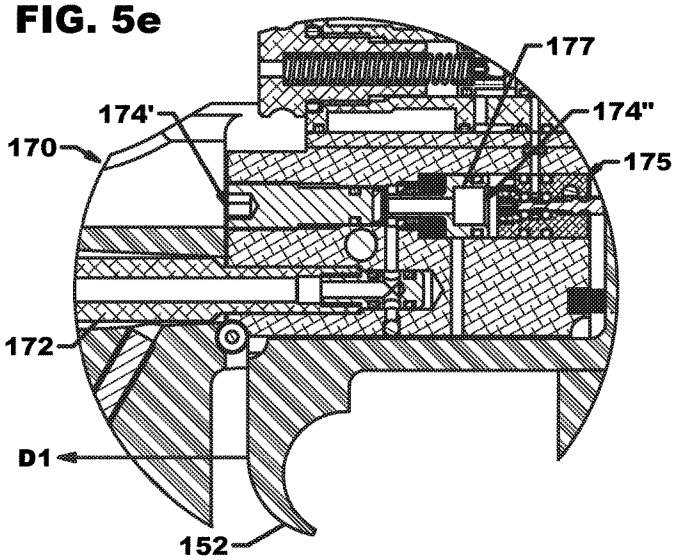
FIG. 5*e* is a magnified cross-sectional view of a portion of an intake assembly of the bolt action firing valve.

While in the ready-to-fire state, compressed air or gas, which enters paintball marker 100 through intake valve 172, is introduced into valve spring chamber 251. With reference to FIGS. 5*e* and 5*f*, as compressed air or gas enters intake valve 172 the gas travels into first portion 174' of regulator 174. From second portion 174" of regulator 174, the gas passes into selector component 175. As can be seen in FIG. 5*f*, the gas passes into bolt action firing valve 220 through Ports 1 and 2 of selector component 175.

In operation, according to an embodiment of paintball marker 100 depicted in FIG. 5*c*, when bolt action firing valve 220 is in the ready-to-fire state and trigger 152 is pressed (such that it slides in direction D1, FIG. 4*a*), lever arm 154 (which is affixed to trigger 152, FIG. 4*a*) is also displaced in direction DI. Displacement of lever arm 154 in direction D1 causes displacement of sear latch 156 in direction D1, thereby causing hammer sear or lever 192 to slightly rotate in a clockwise position. Rotation of hammer sear 192 in a clockwise position thereby causes retaining edge 193 to lower such that it no longer contacts latch rim 249 of ball pusher 248.

Upon hammer sear 192 releasing latch rim 249, hammer spring 246 expands, aiding the propulsion of ball pusher 248 in direction D2 along power tube 240. Ball pusher 248 causes a paintball, previously loaded into firing valve guide assembly 160 of receiver 106, to fire from barrel 108. When trigger 152 is activated, gas previously sealed within valve spring chamber 251 (e.g., in the read-to-fire state illustrated in FIG. 5*c*) is released into power tube chamber 253 creating high gas pressure exerting force behind (or on the back of) the paintball. As depicted in FIGS. 5*c* and 5*d*, when trigger is activated, hammer sear 192 releases hammer 244 from ball pusher 248, whereby the compressed hammer spring 246 propels hammer 244 along power tube in direction D3. Hammer 244 impacts hammer seat 242 thereby displacing power tube 240 in direction D3 causing valve seat 238 to displace in direction D3 and compress valve spring 237. Displacement of valve seat 238 and compression of valve spring 237 allows for the high pressure of compressed gas built up on valve spring chamber 251 to be released and enter power tube chamber 253, creating high gas pressure force behind the paintball thereby aiding in the propulsion of the paintball from barrel 108. Post-firing, hammer spring 246, which extends during firing, compresses thereby bring hammer 244 and ball pusher 248 closer in proximity. Likewise, post-firing, valve spring 237 which during firing compresses, extends back towards equilibrium creating the seal allowing for gas pressure to build within valve spring chamber 251.

With reference to FIG. 5*d*, bolt action firing valve 220 is illustrated in a post firing state. As illustrated in FIG. 5*d*, in a post-firing state hammer 244 and ball pusher 248 are not in relatively (as compared to a ready-to-fire state) close proximity. Also, hammer spring 246 is no longer highly compressed but is instead extended or at a state of equilibrium. As explained above, in post-firing state, hammer spring 246 moves. hammer 244 and ball pusher 248 towards one another again, and valve spring 237 (which compresses during firing) is re-extended, or at a state of equilibrium allowing for sealing of valve spring chamber 251.

Returning bolt action firing valve 220 to the ready-to-fire state requires the user to again turn bolt handle 225 in a first position, then slide bolt handle 225 in a first direction, then turn bolt handle 225 to a second position. As exemplified, user activity is required for firing each paintball when using bolt action firing valve 220.

Figure 6A:
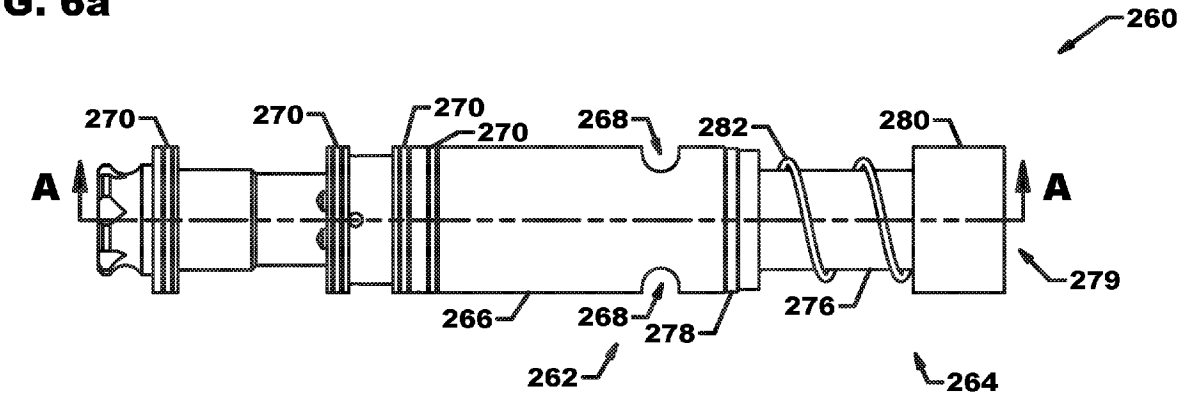
FIG. 6*a* is a side view of the spool firing valve.
Figure 6B:
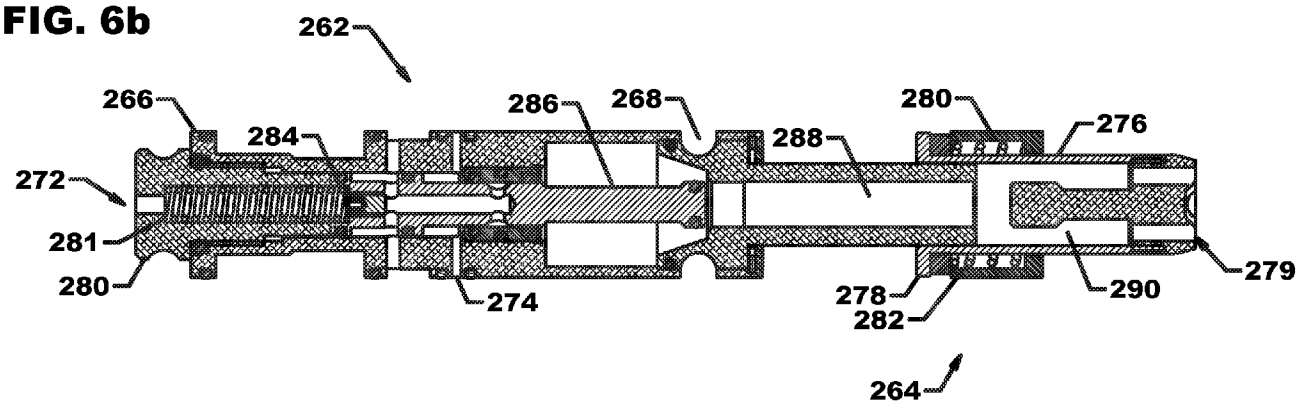
FIG. 6*b* is a cross-sectional view of the spool firing valve in a post-fired state.
Figure 6C:
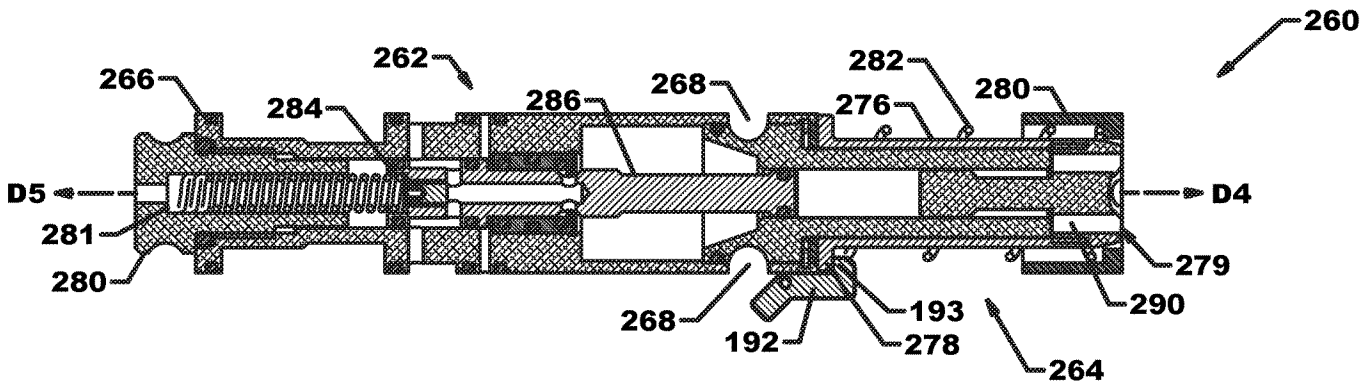
FIG. 6*c* is a view similar to FIG. 6*b* showing a spool firing valve in a ready-to-fire state.
Figure 6I:
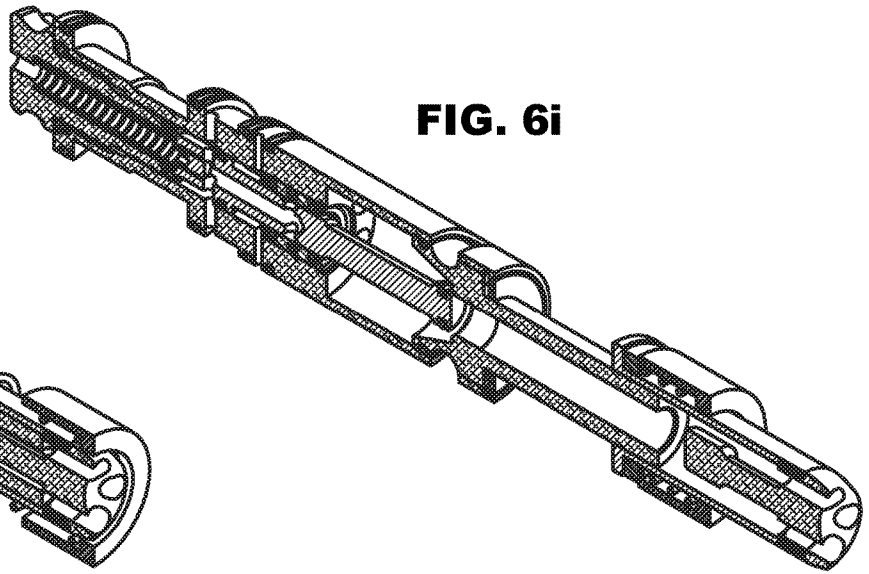
FIG. 6*i* is a perspective view of a spool firing valve in a post-fired state having a portion of the spool valve chassis removed.

According to another embodiment of the present disclosure depicted in FIGS. 6*a*, 6*b*, and 6*c*, firing valve 110 includes spool firing valve 260. With reference to FIG. 6*a*, spool firing valve 260 includes spool valve portion 262 and ball pusher portion 264. It should be understood that spool firing valve 260, in particular spool valve portion 262 and ball pusher portion 264 thereof, are sized to be received within firing valve guide assembly 160 of receiver 106 similar to the manner in which bolt action firing valve 220 is received in firing valve guide assembly 160.

As illustrated in FIG. 6*a*, spool valve portion 262 comprises spool valve chassis 266 which defines valve securing pin notches 268. Spool valve chassis 266 further defines external o-ring grooves 270. With reference to FIG. 6*b*, spool valve chassis 266 is illustrated as also defining backside vent 272 and pneumatic inlet 274.

Returning to FIG. 6*a*, ball pusher portion 264 is depicted as including pusher chassis 276 which defines raised edge 278 and ball pusher surface 279. Ball pusher portion 264 also includes spring retainer 280 and pusher return spring 282. As illustrated, pusher return spring 282 is disposed between raised edge 278 of pusher chassis 276 and spring retainer 280 such that when raised edge 278 is moved closer to spring retainer 280, pusher return spring 282 is compressed. With reference to FIG. 6*b*, spool firing valve 260 is further depicted as including spool valve bulkhead 280 disposed within spool valve chassis 266. As illustrated, spool valve bulkhead 280 defines spring connection component 281 which couples to a first end of valve spring 284, also disposed within spool valve chassis 266. At a second end, valve spring 284 contacts valve spool 286 which is coupled to power tube 288 also disposed within pusher chassis 276.

Similar to bolt action valve 220, spool firing valve 260 is positioned into firing valve guide assembly 160 of receiver 106 and secured therein by way of valve securing pins 165 being inserted through valve securing pin openings 166 of receiver 106. When inserted through valve securing openings 166, valve securing pins 165 are at least partially disposed within valve securing pin notches 268 wherein valve securing pins 165 maintain the orientation and positioning of spool valve chassis 262 within receiver 106.

In operation, when paintball marker 100 employs spool firing valve 260 the introduction of compressed air or gas is controlled, in part, by trigger assembly 150 (FIG. 4*a*). Similar to embodiments of paintball marker 100 having bolt action firing valve 220 as disclosed herein, compressed air or gas enters paintball marker 100 through intake valve 172. With reference to FIG. 6*e*, compressed air or gas enters through intake valve 172 and passes into first portion 174' then second portion 174" of regulator 174. Gas travels from second portion 174" of regulator 174 into selector component 175'. As depicted in FIG. 6*h*, gas passes into spool firing valve 260 through Port 1 of selector component 175' in a ready-to-fire state. In the post-fired state, as shown in FIG. 6*j*, the firing pin translates into a relaxed position such that firing pin and 0 Ring 1 no longer block the flow of gas, allowing gas to flow past 0 Ring 1 and through Ports 1 and 2. The compressed air or gas is then introduced internal to valve spool 286 at pneumatic inlet 274.

Referring to FIG. 6*c*, paintball marker 100 comprising spool firing valve 260 is depicted in a ready-to-fire state. According to an embodiment of paintball marker 100 depicted in FIG. 6*a*, hammer sear 192 is orientated such that retaining edge 193 contacts raised edge 278 of pusher chassis 276 thereby preventing pusher chassis 276 (and ball pusher surface 279) from moving in direction D4. As illustrated in FIG. 4*a*, applying a force in direction D1 to trigger 152 causes trigger 152 to slide in direction D1, thereby causing lever arm 154 to slide in direction D1 also. Sliding lever arm 154 in direction D1 causes sear latch 156 to slide in direction D1, thereby causing hammer sear 192 to slightly rotate in a clockwise position. Rotation of hammer sear 192 in a clock-wise position thereby causes retaining edge 193 to lower such that it no longer contacts raised edge 278 of pusher chassis 276. Additionally, sliding lever arm 154 in direction D1 causes a portion of lever arm 154 (or an attachment thereto) to block flow of compressed air or gas through pneumatic inlet 274.

Figure 6G:
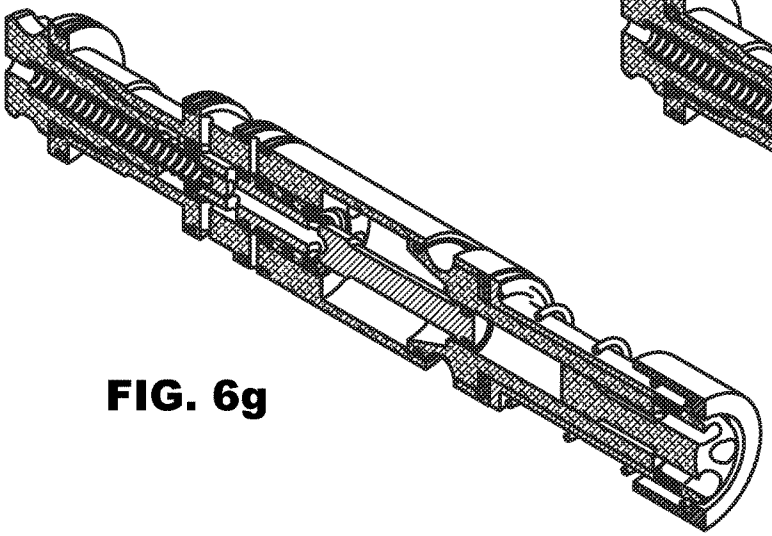
FIG. 6*g* is a perspective view of a spool firing valve in a ready-to-fire state having a portion of the spool valve chassis removed.

Referring to FIGS. 6*c* and 6*g*, release of raised edge 278 allows compressed air or gas to propel pusher chassis 276 along power tube 288 in direction D4 thereby causing ball pusher 290 to be propelled in direction D4. As pusher chassis 276 travels along power tube 288 in direction D4, pusher return spring 282 is compressed between raised edge 278 and spring retainer 280. When the force propelling pusher chassis 276 along power tube 288 (in direction D4) has dissipated such that it is reduced below the force required to further propel pusher chassis 276 along power tube 288, compressed pusher return spring 282 (shown in FIG. 6*b*) exerts a force on raised edge 278 in direction D5, thereby returning pusher chassis 276 to a ready-to-fire state and relieving the compression of pusher return spring 282.

Returning pusher chassis 276 to the ready-to-fire state causes raised edge 278 to travel in direction D5, wherein raised edge 278 passes over retaining edge 193 of hammer sear 192 causing hammer sear 192 to again rotate in a clockwise direction.

Rotation of hammer sear 192 in a clockwise direction lowers retaining edge 193, thereby allowing raised edge 278 to pass over retaining edge 193. Once raised edge 278 passes over retaining edge 193, hammer sear 192 rotates in a counter-clockwise direction such that retaining edge 193 again contacts raised edge 278 of pusher chassis 276, thereby preventing pusher chassis 276 (and ball pusher 290) from moving in direction D4. Upon return of pusher chassis 276 to the ready-to-fire state, magazine 112 loads a paintball into firing valve guide assembly 160 adjacent to ball pusher 290.

Use of spool firing valve 260 in embodiments of paintball marker 100 disclosed herein, allows for a constant flow of compressed air or gas through pneumatic inlet 274 (only interrupted by pressing or sliding trigger 152 in direction D1, FIG. 4*a*). Further, spool firing valve 260 provides the advantage of automatically returning spool firing valve 260 to a ready to fire state upon each shot cycle. As such, the user of paintball marker 100 utilizing spool firing valve 260 is able to increase their rate of firing paintballs.

Figure 6D:
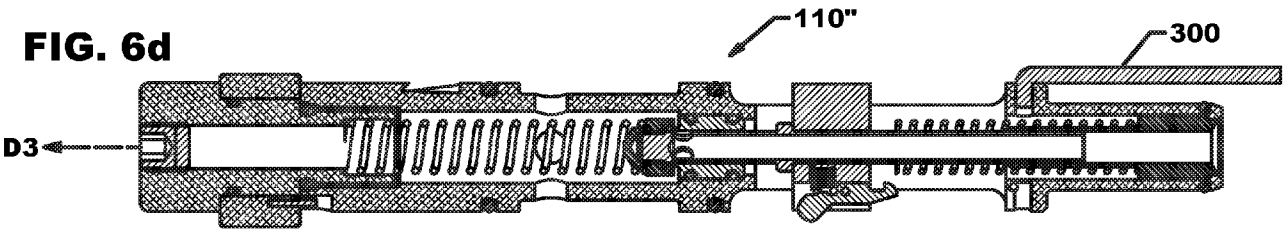
FIG. 6*d* is a side view of a pump action firing valve.
Figure 6E:
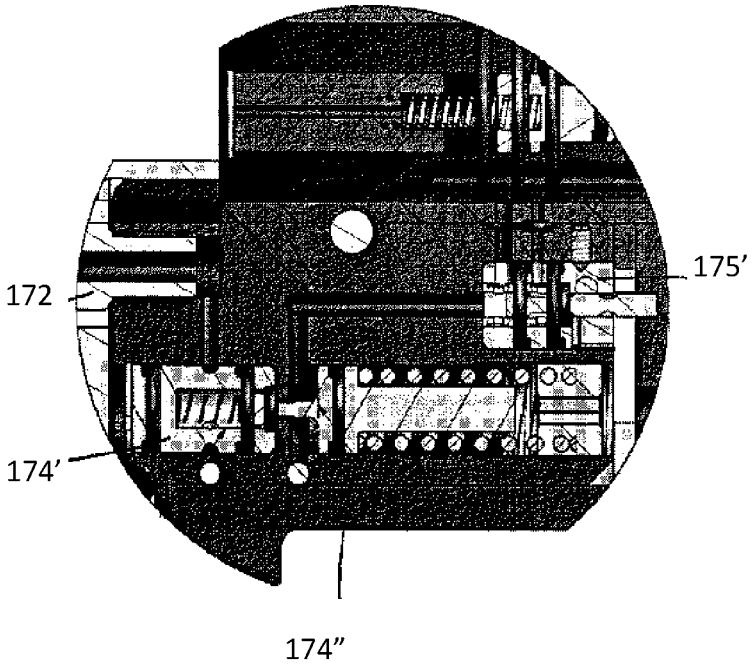
FIG. 6*e* is a magnified cross-sectional view of a portion of an intake assembly of a spool firing valve.

According to yet another embodiment of the present disclosure, firing valve 110 may include a pump action firing valve 110" shown in FIG. 6*d*. According to an exemplary embodiment of pump action firing valve 110", as depicted herein, activation and firing of pump action firing valve 110" is performed similar to the bolt action firing valve 110' described herein. However, unlike bolt action firing valve 110' described herein, pump action firing valve 110" utilizes drive rod 300, which is coupled to a hand grip (not shown), similar to one used on a pump action shot-gun. Instead of translating cycling hub 224, as in bolt action firing valve 110', pump action firing valve 110" utilizes a users driving force from sliding hand grip (not shown) and thereby drive rod 300 in direction D3, thereby placing firing valve 110" in a ready-to-fire state.

According to the present disclosure, paintball marker 100 may alternate between bolt action firing valve 220, spool firing valve 260, and pump action firing valve. By way of example, paintball marker 100 may be configured to utilize bolt action firing valve 220 as described above. However, for any of a myriad of reasons, a user may wish to utilize paintball marker 100 with spool firing valve 260. Paintball marker 100 allows for bolt action firing valve 220 to be removed and replaced with spool firing valve 260.

According to an embodiment of paintball marker 100, bolt action firing valve 220 is placed in a post-fired state, for example after firing paintball marker 100 or by removing the compressed gas pressure. Once in a post-fired state, compressed air or gas supply may be disconnected (if not previously done so) from intake valve 172 and barrel 108 may be detached from receiver 106. By way of example, barrel 108 may be unscrewed from barrel receiving end 168 of receiver 106. Once the compressed air or gas has been disconnected from intake valve 172 and barrel 108 has been removed from receiver 106, receiver 106 may be removed from receiver receiving portion 150 of frame 104 by removing receiver securing pins 161 (allowing a user to remove receiver 106). For example, a user may simply lift (i.e., apply an upward force) receiver 106 out of receiver receiving portion 150 of frame 104. It should be understood that a user may also need to detach magazine 112 from receiver 106 prior to removing receiver 106 from frame 104.

Once receiver 106 is removed from frame 104, valve securing pins 165 inserted into valve securing pin openings 166 of receiver 106 may be removed allowing the user to retract bolt action firing valve 220 from firing valve guide 160. For example, the user may retract bolt action firing valve 220 from firing chamber 164 by pulling on bolt handle 225.

After bolt action firing valve 220 has been removed from firing valve guide 160, the user may then insert spool firing. valve 260 through valve receiving opening 162 of firing valve guide 160. In an embodiment of paintball marker 100 depicted in FIG. 6*a*, spool firing valve 260 is required to be inserted in a specific orientation such that valve securing pin notches 268 are aligned with valve securing pin openings 166 of receiver 106.

Once spool firing valve 260 is inserted into firing valve guide 160 of receiver 106 (in the proper orientation), valve securing pins 165 may be inserted through valve securing pin openings 166 of receiver 106 thereby passing through valve securing pin notches 268 of spool firing valve 260. Thereafter, receiver 106 may be inserted into receiver receiving portion 150 of frame 104, allowing for receiver securing pins 161 to be inserted through receiver securing pin openings 167. Once inserted, receiver securing pins 161 secure receiver 106 to frame 104. Finally, barrel 108, magazine 112, and compressed air or gas source may be coupled to receiver 106 in the appropriate manners described above.

Although described herein as allowing for interchange from bolt action firing valve 220 to spool firing valve 260, it should be understood that paintball marker 100 also allows for interchanging from spool firing valve 260 back to bolt action firing valve 220. Additionally, interchange involving pump action firing valve 110" is performed in the manner described according to bolt action firing valve 220 described herein.

According to one aspect of the present disclosure, components of paintball maker 100 can be used other paintball marker configurations. For example, receiver 106 can be removed from chassis 104 and used in the chassis of another paintball marker configuration.

Figure 8:
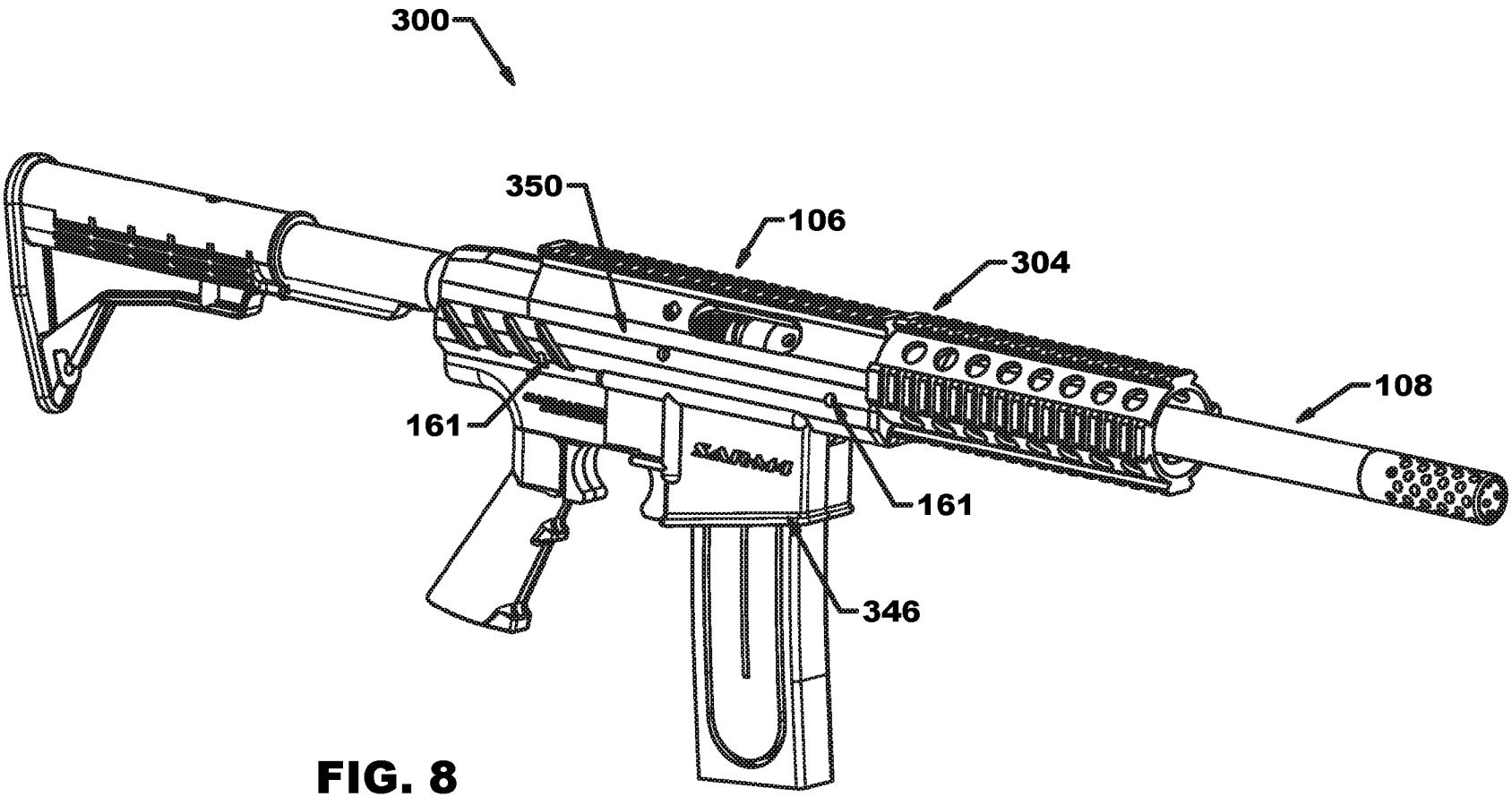
FIG. 8 is a perspective view of an alternative embodiment paintball marker according to the instant disclosure showing the receiver and magazine of the paintball maker of FIG. 1 positioned in a different frame or chassis.

As shown in FIG. 8, receiver 106 is positioned in chassis 304 of paintball marker 300. As discussed above, receiver 106 can be removed from chassis 104 of paintball maker 100 by first unscrewing barrel 108, removing securing pins 161 from chassis 104, and removing magazine 112 from receiver 106; and then pulling receiver 106 upward out of chassis 104.

After removal from chassis 104 of paintball marker 100, receiver 106 may be positioned in a receiver receiving portion 350 of chassis 304 of paintball maker 300. Next, magazine 112 is inserted into receiver 106 through a magazine receiving portion 344 of chassis 304, a barrel 308 of paintball marker 300 is screwed into receiver 106 through a barrel receiving portion 346 of chassis 304, and securing pins 161 are positioned in pin receiving apertures of chassis 304.

Figure 9:
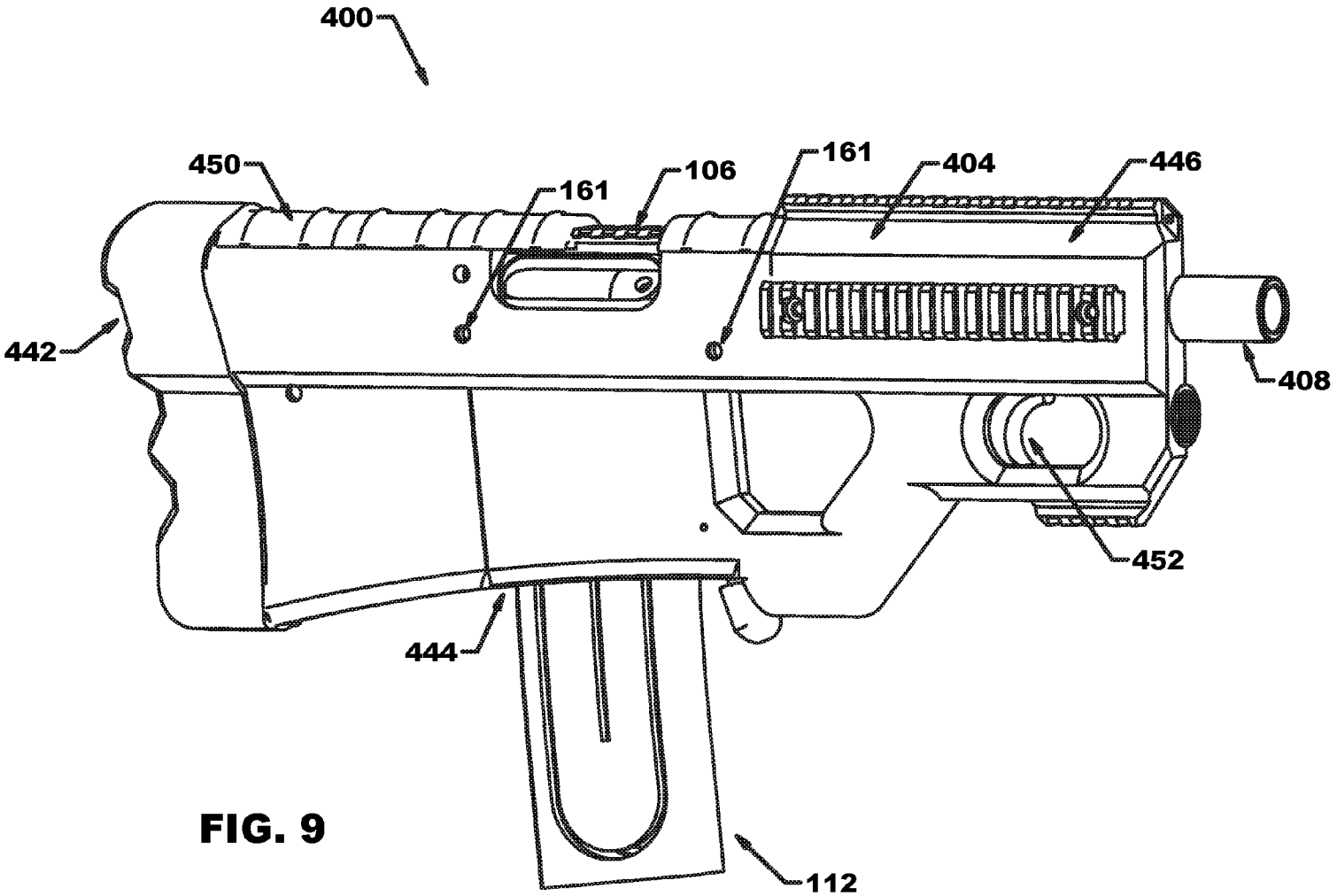
FIG. 9 is a perspective view of yet alternative embodiment paintball marker according to the instant disclosure showing the receiver and magazine of the paintball maker of FIG. 1 positioned in another different frame or chassis.

As shown in FIG. 9, receiver 106 is positioned in chassis 404 of paintball marker 400. After removal from chassis 104 of paintball marker 100 or chassis 304 of paintball marker 300, receiver 106 may be positioned in a receiver receiving portion 450 of chassis 404 of paintball maker 400. Next, magazine 112 is inserted into receiver 106 through a magazine receiving portion 444 of chassis 404, a barrel 408 of paintball marker 400 is screwed into receiver 106 through a barrel receiving portion 446 of chassis 404, and securing pins 161 are positioned in pin receiving apertures of chassis 404. Unlike chassis 104 and chassis 304 which receive receiver 106 through an opening in the top of the respective chassis 104, 304, receiver 106 is received through the rear or back of chassis 404. A rear rubber cap 442 is removable from chassis 404 that covers a rear opening in chassis 404. During insertion, receiver 106 is slid through the back opening into chassis 404. Once inserted, rubber cap 442 is placed back over the opening. As shown in FIG. 9, trigger 152 is covered by chassis 304. A second front trigger 452 is provided in front of magazine 112 on the opposite side of trigger 152.

Figure 10:
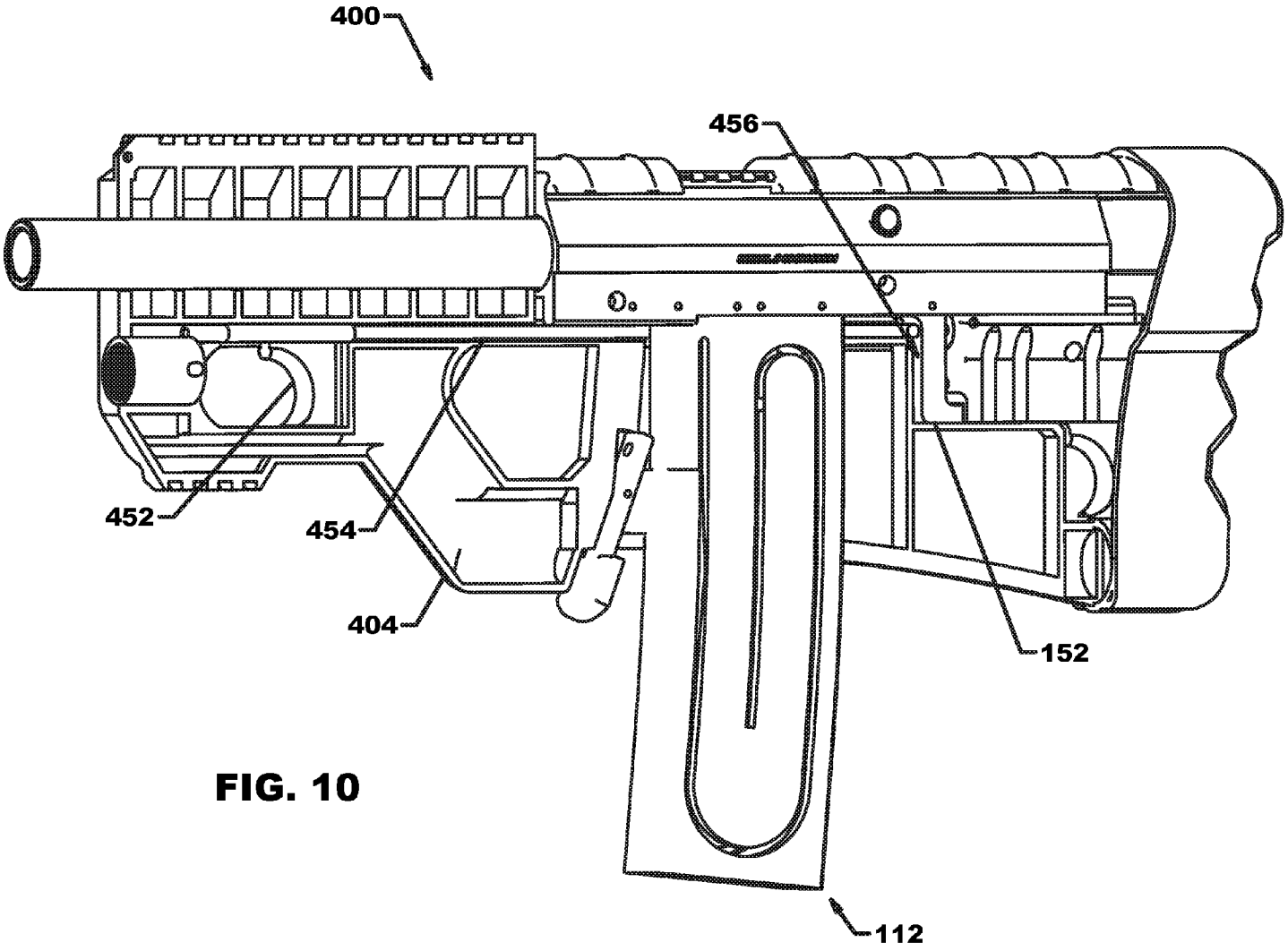
FIG. 10 is a side view of the paintball maker of FIG. 9 with portions removed showing a trigger rod transferring actuation of a forward trigger to a rearward trigger.

As shown in FIG. 10, a rod 454 is provided between front trigger 452 and rear trigger 152 that actuates rear trigger 152 when front trigger 452 is pulled. Rod 454 contacts a corner 456 of trigger 152.

Figure 11:
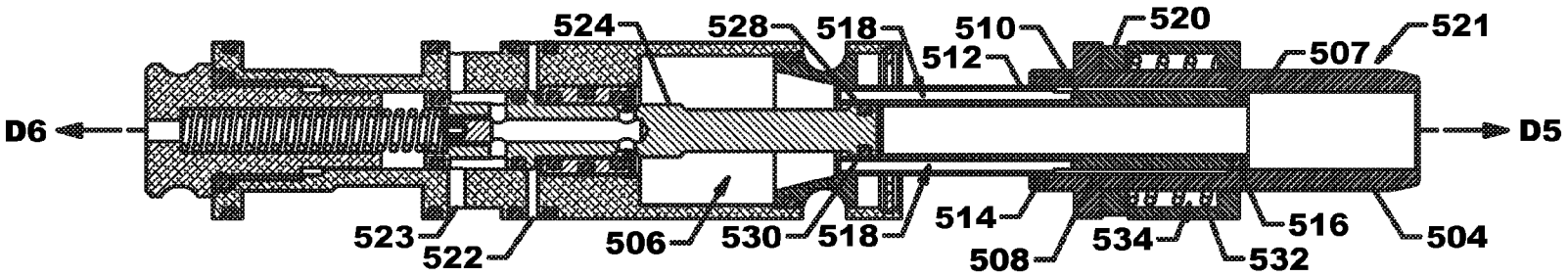
FIG. 11 is a is a cross-sectional view of an embodiment of a closed bolt semi auto engine of an exemplary paintball marker in a first configuration.
Figure 12:
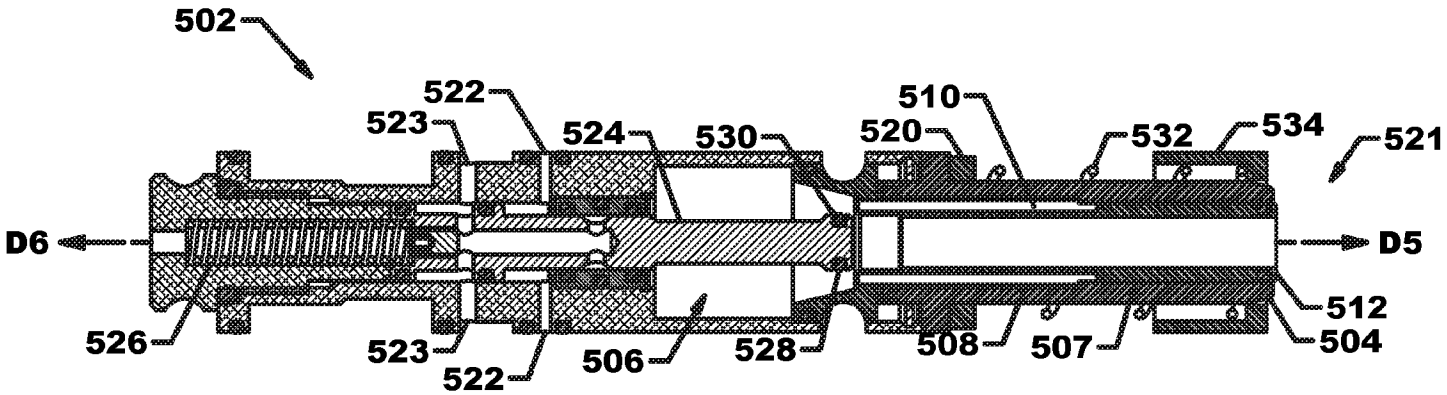
FIG. 12 is a is a cross-sectional view of an embodiment of a closed bolt semi auto engine of an exemplary paintball marker in a second configuration.

Referring next to FIGS. 11 and 12, in one embodiment the paintball marker includes a closed bolt powertrain assembly 502. As shown in FIG. 11, the assembly 502 is illustrated in a first configuration, such as at the beginning of a cycle, when the marker is not being fired, or when the user's finger is not depressing the trigger.

In the first configuration, the bolt 504 is in a first, closed configuration, in which the bolt 504 is extended in direction D5, covering the breach area 521 where a paintball or projectile (not shown) enters the breach area 521 from a magazine (not shown). Chamber 506 is initially filled with compressed air or gas from air inlet 523 fluidly connected to an external compressed air or gas source (not shown). Bolt 504 has a small diameter 507 and a large diameter 508. Chamber 510, defined between large diameter 508 and powertube 512 is fluidly sealed by O-rings 514, 516 except for a fluid connection with chamber 506 through one or more passageways 518. The pressure of the compressed air or gas in chamber 510 creates an unbalanced force on bolt 504 along powertube 512 in the direction D5 away from the main body of the powertrain assembly 502. Bolt 504 may rest on a rubber bumper 520 in the first configuration.

As shown in FIG. 12, when a trigger (not shown) is pulled or otherwise activated, the fire control valve (not shown) directs pressure from a compressed air or gas source to air inlet 522. The compressed gas or air entering air inlet 522 drives back poppet 524 in direction D6, compressing valve return spring 526. The seal 528 existing between powertube 512 and poppet 524, particularly between powertube 512 and O-ring 530 on poppet 524, is broken and the compressed gas or air of chamber 506, which is fluidly connected with the external compressed air or gas source, is released into the breach area 521 behind the paintball or projectile, driving the paintball or projectile out the barrel (not shown) and out of the paintball marker. As shown in FIG. 12, when a trigger (not shown) is pulled or otherwise activated, the fire control valve (not shown) directs pressure from a compressed air or gas source to air inlet 522. The compressed gas or air entering air inlet 522 drives back poppet 524 in direction D6, compressing valve return spring 526. The seal 528 existing between powertube 512 and poppet 524, particularly between powertube 512 and O-ring 530 on poppet 524, is broken and the compressed gas or air of chamber 506 is released into the breach area 521 behind the paintball or projectile, driving the paintball or projectile out the barrel (not shown) and out of the paintball marker.

With the release of pressure from chamber 506, the bolt spring return 532, which couples bolt 504 to return spring pocket 534, drives the bolt 504 to the second configuration shown in FIG. 12. In the second configuration, the bolt 504 is in an open configuration, in which the bolt 504 is extended in direction D6 where the breach area 521 is not covered. This allows a new paintball or projectile (not shown) to enter the chamber from a magazine (not shown) attached to the paintball marker.

The trigger (not shown) is then released. The fire control valve (not shown) releases pressure from the compressed air or gas source to air inlet 522, allowing pressure inside air inlet 522 to discharge. Valve return spring 526 moves in direction D5 back towards equilibrium to reseat the poppet 524 and seal off the valve chamber 506 by sealing the valve chamber seal 528 with O-ring 530 of poppet 524. Air pressure through air inlet 523 flows into the valve chamber 506.

As the pressure builds, the passageways 518 fluidly connecting valve chamber 506 with chamber 510 provide pressure in chamber 510 to move bolt along powertube 512 in direction D5 back towards the first configuration seen in FIG. 11. The cycle completes when the bolt 504 has moved back into position and rests against rubber bumper 520.

While this disclosure has been described as having an exemplary design, the present disclosure may be further modified within the spirit and scope of this disclosure. This application is therefore intended to cover any variations, uses, or adaptations of the disclosure using its general principles. Further, this application is intended to cover such departures from the present disclosure as come within the known or customary practice in the art to which this disclosure pertains.

What is claimed is:

1. A paintball marker including:

a frame portion;

a trigger mechanism;

a barrel for propelling a paintball therefrom;

a removable bolt action firing valve and a removable spool firing valve; and a receiver portion at least partially received into the frame portion and coupled to the trigger mechanism, the barrel coupled to one of the receiver portion and the frame portion, the receiver portion defining a firing chamber sized to removably receive the bolt action firing valve and secure the bolt action firing valve in a first orientation in the firing chamber, the receiver portion adapted to receive a paintball from a paintball reservoir and compressed gas from an external source to propel the paintball, wherein the firing chamber is sized to removably receive the spool firing valve when the bolt action firing valve is removed therefrom, the firing chamber configured to secure the spool firing valve in a first orientation.

2. The paintball marker of claim 1, wherein the bolt action firing valve includes a translatable cycle hub having a bolt handle.

3. The paintball marker of claim 1, wherein the barrel screws into the receiver portion.

4. The paintball marker of claim 1, wherein the receiver portion is adapted to be at least partially received into the frame portion while coupled to the barrel.

5. The paintball marker of claim 1, wherein the paintball reservoir comprises a magazine couplable to the receiver portion, the magazine including two vertical columns of paintballs stacked on top of each other within each column.

6. The paintball marker of claim 5, wherein the magazine is configured to allow discharge of one of the two vertical columns at a time.

7. The paintball marker of claim 6, wherein the magazine defines an opening above each vertical column, the openings sized to allow the paintballs to pass therethrough.

8. The paintball marker of claim 7, wherein the magazine includes a coil spring configured to apply a force on the vertical columns of paintballs in a direction toward the openings above each vertical column.

9. The paintball marker of claim 1, wherein the trigger mechanism includes a trigger and lever arm which when activated slide along a first axis.

10. The paintball marker of claim 1 further comprising a stock adapted for removably attaching to the frame portion, the stock including a cheek abutment and a shoulder abutment.

11. The paintball marker of claim 10 further including a first adjuster and a second adjuster, the first adjuster adapted for altering the positioning of the cheek abutment and the second adjuster adapted for altering the positioning of the shoulder abutment.

12. The paintball marker of claim 1, wherein the receiver portion is further configured for mounting a sight thereto.

13. A method of interchanging a bolt action firing valve in a paintball marker with a spool action firing valve, the method including the steps of:

disposing a receiver at least partially within a frame;

placing a bolt action firing valve disposed within the receiver in a post-fired state;

removing the bolt action firing valve from a firing chamber defined by the receiver, said step of removing the bolt action firing valve comprising removal of at least one valve securing pin from a valve securing pin opening defined by the receiver and retracting the bolt action firing valve through an opening defined by the receiver;

inserting a spool firing valve into the firing chamber of the receiver by inserting the spool firing valve through the opening, the step of inserting comprising placing the spool firing valve in a first configuration within the firing chamber of the receiver; and inserting the at least one valve securing pin through the valve securing pin opening defined by the receiver, the step of inserting further including disposing the at least one valve securing pin within an aperture defined by the spool firing valve.

14. The method of claim 13 further including the steps of:

disconnecting a barrel from the receiver prior to the step of removing the receiver from the frame; and reconnecting the barrel to the receiver after the step of securing the receiver within the frame.

15. The method of claim 14, wherein the step of disconnecting the barrel includes unscrewing the barrel from the receiver.

16. The method of claim 13 further including the steps of:

disconnecting a magazine enclosing a plurality of paintballs from the receiver prior to said step of removing the receiver from the frame; and reconnecting the magazine to the receiver after the step of securing the receiver within the frame.

17. The method of claim 13 further including the steps of:

disconnecting a pressure source from the receiver, the pressure source selected from the group consisting of a compressed air source and a compressed gas source;

removing the receiver from the frame, the step of removing comprising removal of at least one receiver securing pin from a receiver securing pin opening defined by the frame;

placing at least a portion of the receiver within the frame;

securing the receiver within the frame, said step of securing comprising inserting the at least one receiver securing pin into the receiver securing pin opening; and, reconnecting the pressure source to the receiver.

* * * * *